United States Patent [19]

Blake, III

[11] Patent Number: 4,991,779

[45] Date of Patent: Feb. 12, 1991

[54] FOAM GENERATING DEVICE

[76] Inventor: Joseph W. Blake, III, 88 Main St., New Canaan, Conn. 06840

[21] Appl. No.: 481,435

[22] Filed: Feb. 16, 1990

Related U.S. Application Data

[62] Division of Ser. No. 57,037, Jun. 2, 1987, Pat. No. 4,901,925.

[51] Int. Cl.[5] ..... B05B 7/32

[52] U.S. Cl. ..... 239/343; 222/189; 222/190; 239/346; 239/366; 239/370; 239/371; 239/417.3; 239/432

[58] Field of Search ..... 239/343, 346, 350, 366, 239/416.5, 417.3, 417.5, 432; 222/189, 190

[56] References Cited

U.S. PATENT DOCUMENTS

| | | | |
|---|---|---|---|
| 3,937,364 | 2/1976 | Wright | 239/343 |
| 4,022,351 | 5/1977 | Wright | 222/190 |
| 4,044,923 | 8/1977 | Gardner | 239/343 |
| 4,531,659 | 7/1985 | Wright | 222/190 |
| 4,531,660 | 7/1985 | Ford, Jr. | 222/209 |

*Primary Examiner*—Andres Kashnikow
*Assistant Examiner*—Michael J. Forman
*Attorney, Agent, or Firm*—Seymour G. Bekelnitzky

[57] ABSTRACT

A foam producing device for the alternative dispensing of foams or liquids comprising a porous element a partially gas permeable wall, a gas distributing plenum a gas entry port in fluid connection with said plenum; a second wall opposite the outer surface of said gas permeable wall; a mixing chamber comprising at one end, the proximal end, a small annular opening between said gas permeable and second wall, comprising an orifice for the uniform distribution of foamable liquids therethrough into said chamber and at the distal end an exit port for the discharge of foams or liquids from said chamber said chamber being tapered or not, as required; a liquid distribution plenum for the uniform distribution of said foamable liquids to said orifice and a liquid entry port in fluid connection, through a conduit with said plenum wherein said plenum and a source of foamable liquid are in fluid connection through a conduit therebetween; with the proviso that only the portion of said gas permeable wall between said orifice and said exit port is gas permeable said device further comprising, in the conduit between said pressurized gas source and said gas distributing plenum valve means to prevent entrance of said gas to said device when only the dispensing of liquid is desired.

9 Claims, 2 Drawing Sheets

FIG. 1
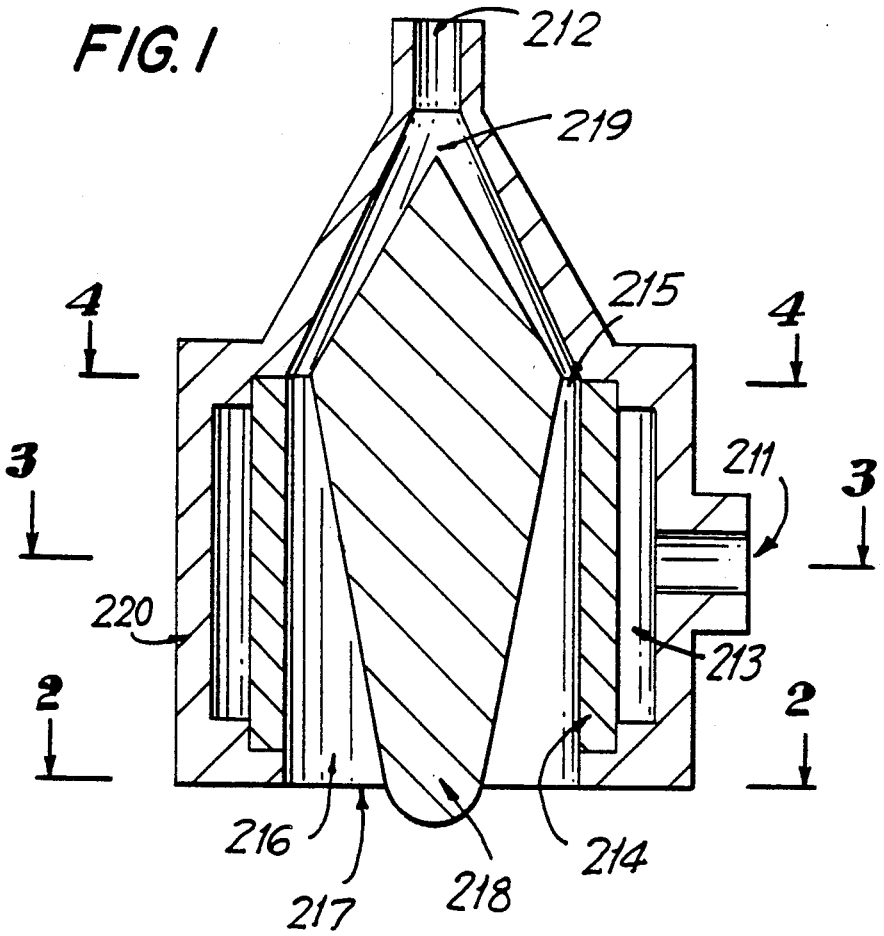
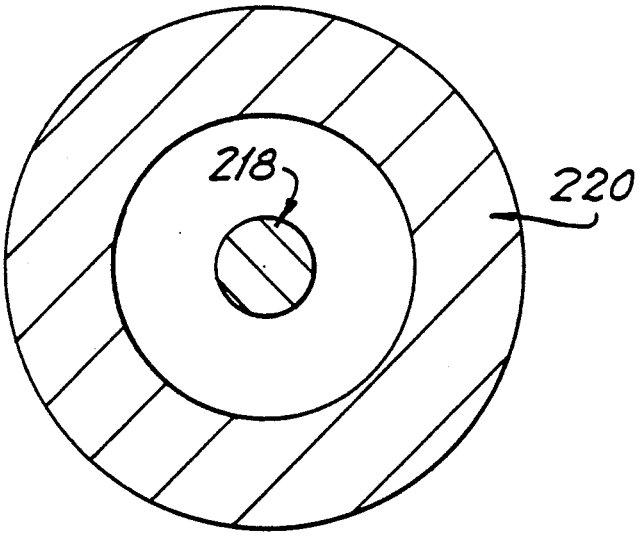
FIG. 2

FIG. 3
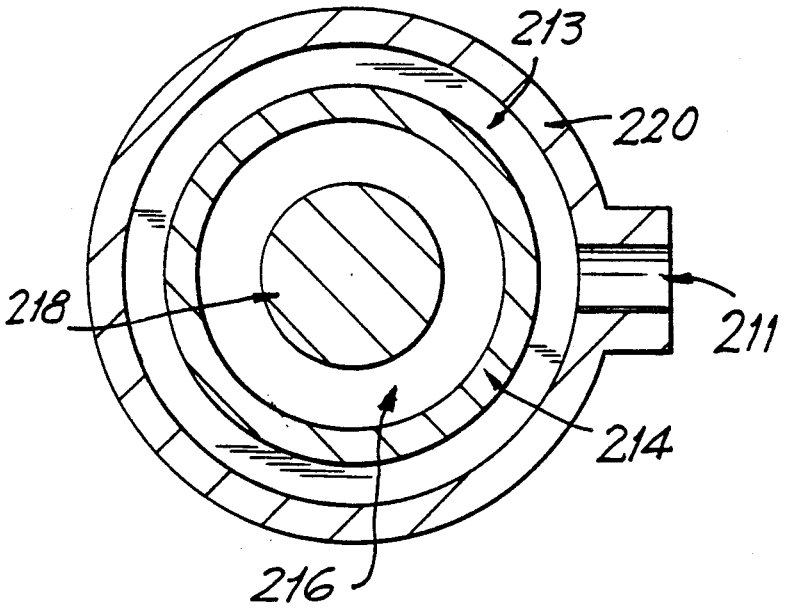
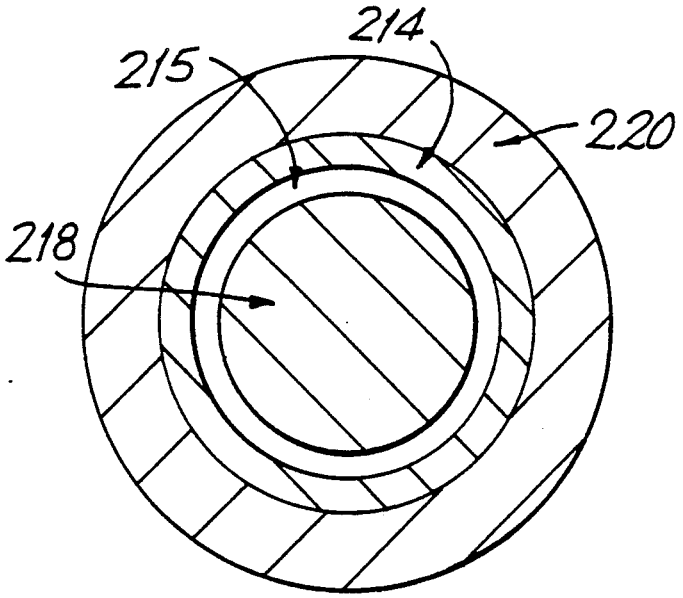
FIG. 4

FOAM GENERATING DEVICE

This is a division of application Ser. No. 07/057,037 filed June 2, 1987, now U.S. Pat. No. 4,901,925, issued Feb. 20, 1990.

BACKGROUND OF THE INVENTION

This invention relates to foam dispensing devices and more particularly to foam producing devices for use with fluids which tend to clog the pores of conventional foam dispensing devices said devices also permitting the dispensing, if desired, of the fluid as a liquid rather than foam.

Numerous foam dispensing devices of a non-aerosol type, which are essentially hand held squeeze bottles of relatively small capacity, have been described in, e.g., U.S. Pat. Nos. 3,709,437 and 3,937,364. However, their characteristics cannot be extrapolated to devices of economically desirable large capacity. This is due to the fact that pressure and liquid capacity control is difficult to achieve in view of the small size required in the foam producing means to produce the most desired foams.

U.S. Pat. No. 4,531,660 describes a device intended to overcome the above disadvantages by placing a small inner chamber, chamber, associated with the foam producing means, said combination maximizing the foam quality, within a large chamber or reservoir of economically desirable large capacity.

However, said devices suffer from the disadvantage, by virtue of the foam outlet means being part of the foam producing means must precede it with the concomitant result, that with certain fluids, such as Povidone TM, the pores of the foam producing means are ultimately clogged. This is a consequence of the foams (i.e., the foamable liquid and gas) having to pass through the pores of the foam producing means.

In addition, as the foam producing means are inserted within the mouth of the foam dispensing device it is necessary to package the foamable liquid and foam producing means as a single unit whereby portability and versatility are decreased.

It is believed, although the theory is not essential to the practice of the invention, that fluids, such as Povidone TM, which are based on polymeric materials, clog the pores of the foaming means by separation and buildup of the polymeric moieties upstream of and/or within the pores.

It is to be understood throughout the application that references to air and gas may be used interchangably and that the term gas refers to inert gases such as nitrogen.

Furthermore, the described invention makes no provision for dispensing the foamable liquid in a liquid form, if desired, as an alternative to the foam form.

The instant invention to the contrary obviates the above difficulties in that the mixing of the foamable liquid and gas occurs only outside of the container, or reservoir and outside (i.e., downstream) of the pores of the foam producing means. Thus, only the foam producing gas passes through the pores of the foam producing means, when desired, to mix with the foamable liquids to form foams which do not pass through any porous materials after formation.

It is to be understood throughout the application that references to air and gas may be used interchangably and that the term gas refers to inert gases such as nitrogen.

SUMMARY OF THE INVENTION

An object of the invention is to provide foam dispensing device for the alternative dispensing of either foams or liquids.

Another object of the invention is to provide means of producing foams in said foam dispensing device of without clogging of the pores of the porous element of the foam producing means.

According to yet another object of the invention there is provided liquid delivery means which a large outer container, for holding liquid, having a discharge port, an inner container disposed within said outer container and in liquid connection therewith through a port; a closure for said inner container having pressurized air inlet means and foamable liquid outlet means; a tube descending vertically from said closure in liquid communication with he liquid outlet means having an opening at its lower end to provide liquid communication with said inner container; one-way valve means in the inner container to close the port between the inner and outer containers when pressure within the inner container is increased to supply liquid through said liquid outlet means to the foam producing means and to open said port to permit flow of liquid from the outer container to the inner container when pressure in the inner container is decreased.

It is another aspect of the invention to provide foam producing means which are external to both the inner and outer containers.

Yet another object of the invention is to provide means to alternatively generate foams or dispense unfoamed liquids comprising a porous element a partially gas permeable wall, a gas distributing plenum a gas entry port in fluid connection with said plenum; a second wall opposite the outer surface of said gas permeable wall; a mixing chamber comprising at one end, the proximal end, a small annular opening between said gas permeable and second wall, comprising an orifice for the uniform distribution of foamable liquids therethrough into said chamber and at the distal end an exit port for the discharge of foams or liquids from said chamber said chamber being tapered or not, as required; a liquid distribution plenum for the uniform distribution o said foamable liquids to said orifice and a liquid entry port in fluid connection, through a conduit with said plenum wherein said plenum and a source of foamable liquid are in fluid connection through a conduit therebetween; with the proviso that only the portion of said gas permeable wall between said orifice and said exit port is gas permeable said device further comprising, in the conduit between said pressurized gas source and said gas distributing plenum valve means to prevent entrance of said gas to said device when only the dispensing of liquid is desired.

Another aspect of the invention is to provide valve means to prevent entrance of said gas into said porous element when only dispensing of liquid is desired.

Yet another aspect of the invention is to provide a squeeze bottle type of foam dispensing device comprising a container, or reservoir, for foamable liquid, comprising a semi-rigid container comprising at one end a discharge port, to supply foamable liquid to the foam producing means which can dispense said foamable liquid in the form of foam or liquid, alternatively.

According to this aspect there is provided foam producing means comprising a housing comprising a base comprising air and liquid inlet ports; a porous element comprising a partially porous wall and an air inlet port in fluid connection with the air inlet port of said base; a fluid distribution base, into which the base of the housing may be rotatably inserted, comprising air and liquid outlet ports, and a hollow tube, or conduit, descending vertically thereform in fluid connection with said air outlet port the opposite end being sealed by a one-way valve which opens upon inversion of the outer container of the foam dispensing device and application of pressure thereto, for passage of air therethrough, and, if desired, into said porous element said valve closing, upon release of pressure to the outer container, with a concomitant decrease of pressure therein, and reinversion thereof, to prevent flow of liquid and/or air into said conduit; the base of said housing being partially rotatable within said distribution base to permit aligning of all of the liquid transmission ports when only dispensing of liquid is desired, aligning of both the liquid and air transmission ports when generation and dispensing of foams is desired and aligning none of said ports when no dispensing is desired.

The foamable liquid reservoir comprises at one end a discharge port into which the foam producing means is inserted and held in place by a cap having internal threads matched to the external threads of the neck of said reservoir or other retaining means known to the art.

BRIEF DESCRIPTION OF THE DRAWINGS

FIG. 6 is an elevational sectional view of an alternate gas valving system for the foam dispensing device of FIG. 1.

FIG. 14 is an elevational cross-sectional view of a third embodiment of the invention.

FIG. 15 is a sectional view taken along line I—I of FIG. 14 in the direction indicated.

FIG. 16 is a sectional view taken along line J—J of FIG. 14 in the direction indicated.

FIG. 17 is a sectional view taken along line K—K of FIG. 14 in the direction indicated.

DETAILED DESCRIPTION OF THE PREFERRED EMBODIMENT

Figure 1:
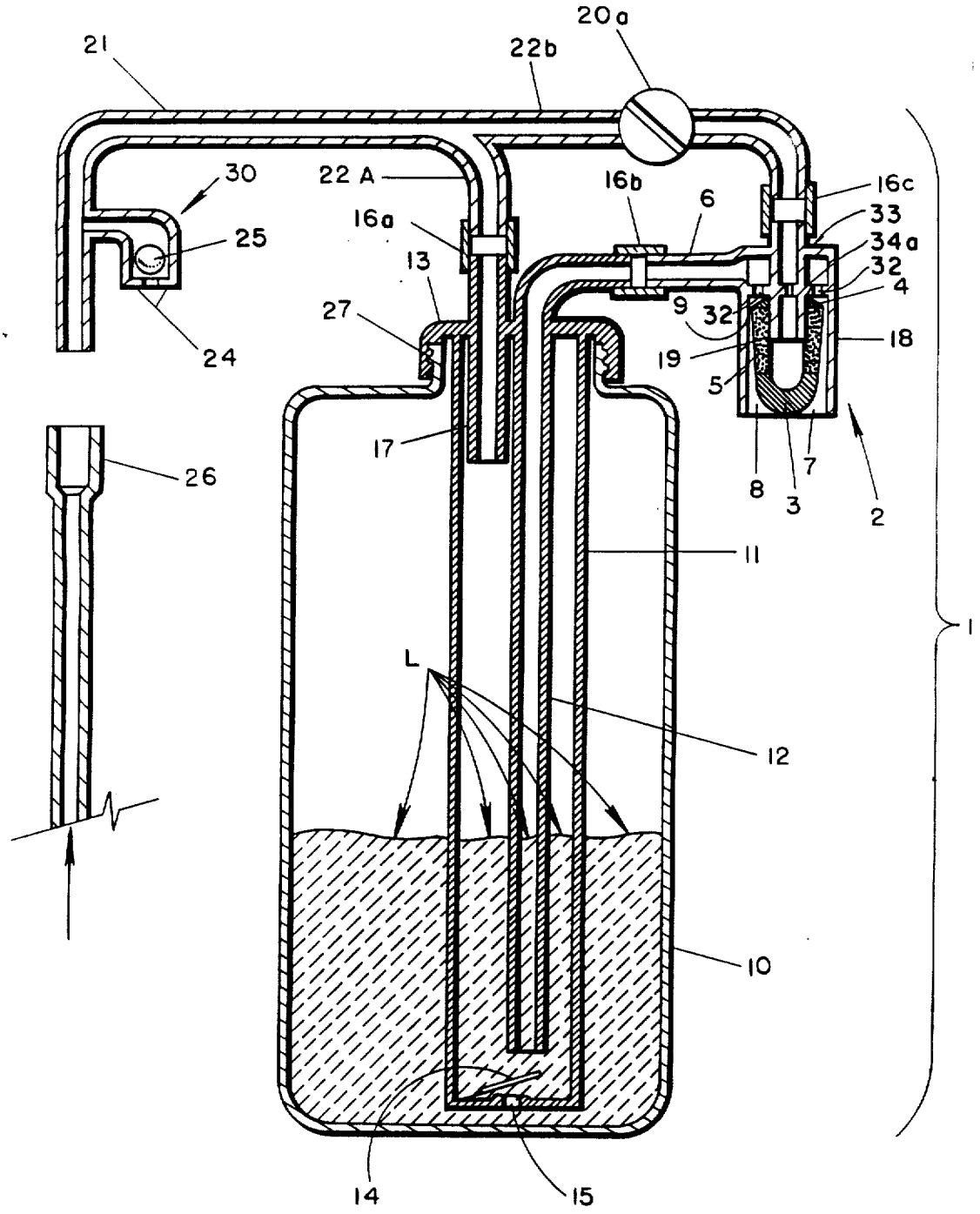
FIG. 1 is an elevational sectional view of the foam dispensing device of the invention.

Referring now to FIGS. 1-5 there is described a foam dispensing device which is generally indicated by 1 comprising an outer container 10 having a neck 27 which defines an exit port. The device also includes a cap 13, which may be affixed to the outer portion of said neck means by matched threads on the inner portion of the vertical wall of said cap and the outer wall of said neck or by any other means known to the art.

The outer container 10 provides a large reservoir of foamable liquid, L. and may be formed of any compatible rigid or non-rigid materials such as plastics, metals & glasses.

The cap also provides a tubular element 11 descending vertically therefrom and forming an inner container within said outer container which acts as a smaller auxiliary reservoir for the foamable liquid.

The cap 13 further comprises a gas inlet stem 17 passing therethrough for admission of pressurized air to the inner container and a tube 12 descending vertically from the bottom of said cap said tube having an opening at the bottom thereof for liquid connection to the inner container for transfer of foamable liquid from said inner container to the foam producing means upon application of pressurized air to the surface of said liquid L in the inner container 11.

The foam dispensing device further comprises foam producing means in fluid connection with said inner tube 12. Said foam producing means may be inserted in the neck of container 10 or external thereto.

Figure 2:
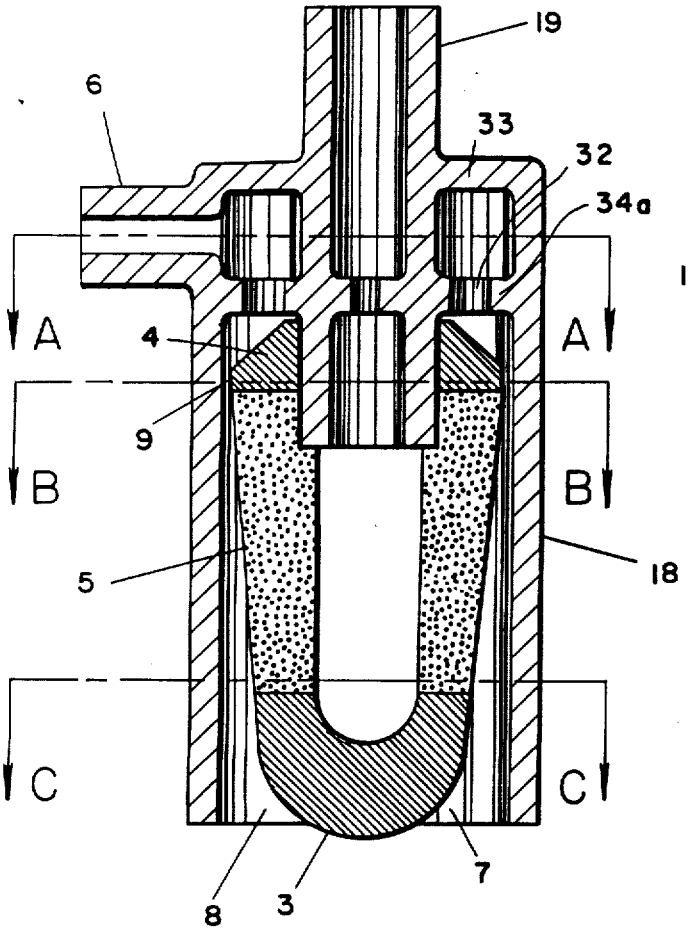
FIG. 2 is an elevational sectional view of the foam producing means of the invention.
Figure 3:
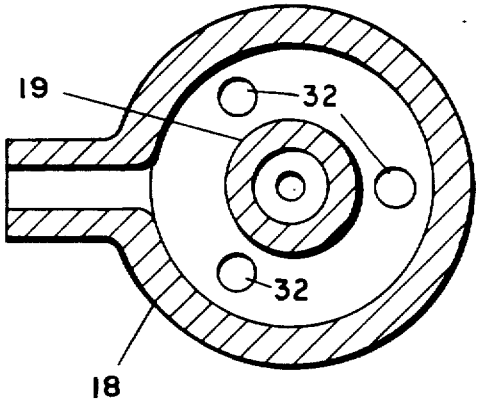
FIG. 3 is a cross-sectional view of the foam producing means along line A—A of FIG. 2.
Figure 4:
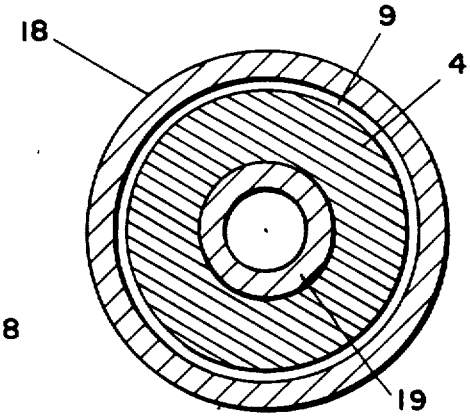
FIG. 4 is a cross-sectional view of the foam producing means along line B—B of FIG. 2.
Figure 5:
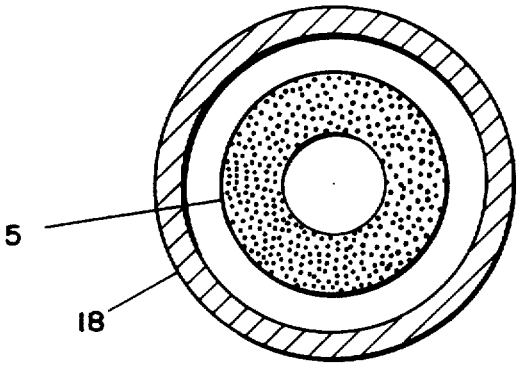
FIG. 5 is a cross-sectional view of the foam producing means along line C—C of FIG. 2.
Figure 7:
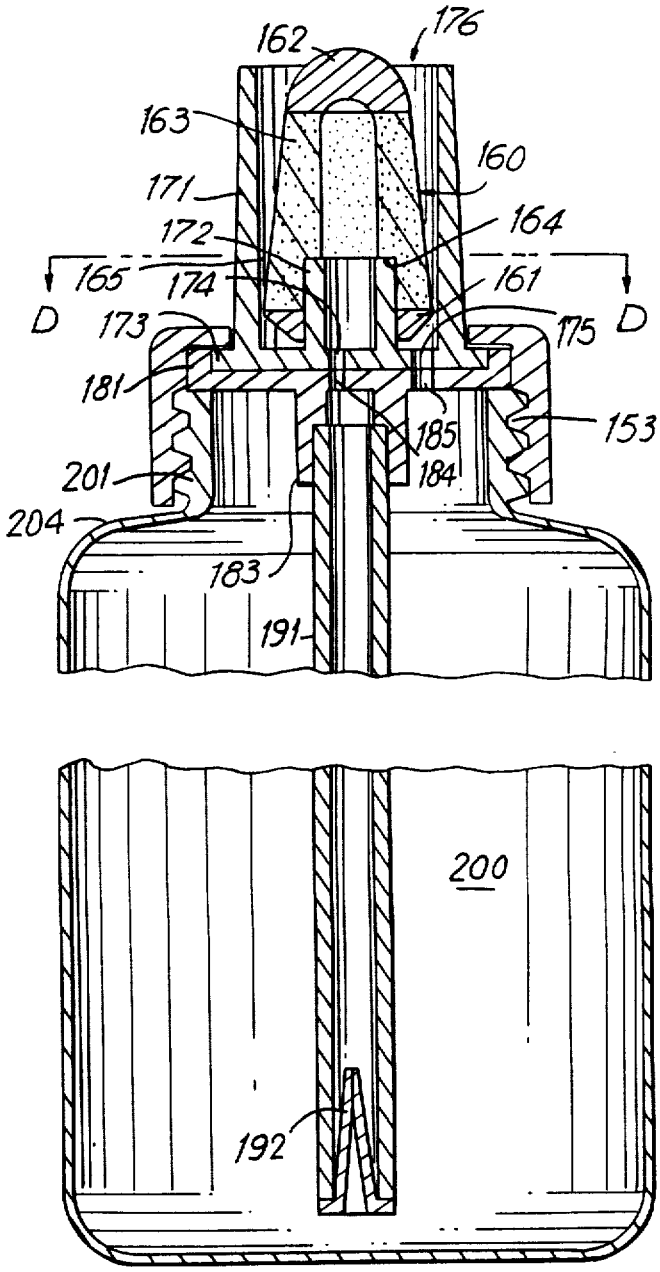
FIG. 7 is an elevational sectional view of a second embodiment of this invention.

As shown in FIGS. 2, 4 and 5 the foam producing means, generally indicated by the numeral 2 comprises a housing 18 comprising a porous element 7, and gas inlet means comprising a stem 19 passing through the upper 33 and inner 31 walls of said housing and into said porous element for the delivery of pressurized air thereto as required.

The wall of said porous element 7 flares outwardly from the inlet port thereto and the end opposite said inlet port to create a narrow annular space, or orifice 9, between said element and the inner wall of the housing. The portion 4 of the wall of the element between said orifice and the inlet port of the element as well as the portion 3 of the wall of the element extending from the other end towards said orifice are non-porous and air cannot diffuse through those portions of the element 7. The remainder 5 of said wall is porous. The porous portion of the wall may be chosen from materials well known in the art such as 70 $\mu$m open celled polyethylene. The non-porous portions may be formed in any manner known in the art including painting and curing of an epoxy resin on a preformed porous wall in those areas where non-porosity is desired. Furthermore, if desired, the permeability of the porous portion may be limited to only gases and even to specific gases. The choice of materials and processes will be selected by the user in accordance with his requirements.

Said housing 18 further comprises fluid inlet means 6, positioned between the horizontal walls 31 and 33 of said housing, which is in fluid communication with the liquid outlet means 12 of the inner container 11 through connector 16*b* and with the space between said porous element and said housing wall 18 through liquid entry port 232 in inner horizontal wall 31 of said housing.

The dispensing device further comprises a dual branched pressurized air delivery tube 21 in fluid connection, at a first branch 22*b*, with inlet stem 19 through valve 20*a* and connector 16*c*. Said gas delivery tube is also in fluid connection, at a second branch 22*a*, with stem 17 through connector 16*a*.

Said tube 21 further comprises a one-way valve for return of air to the pressurized air source comprising a port 23 for admission of air to the tube 21, a valve seat 24 and a ball 25 whose diameter is greater than that of the valve seat.

It is, of course, understood that any one-way valve, known to the art may be used here.

Furthermore, as desired, other compatible pressurized gases, such as nitrogen, may be used in lieu of air as well as other means of relieving the pressure in tube 21 or for other applications where air is called for.

Fluid connection between tube 21 and the pressurized air source is provided by means of connection 26.

Said inner container 11 further comprises at its lower end a liquid entry port 15 and a flapper valve 14 which closes said port when the pressure within said inner container exceeds that in the outer container.

Thus, in the embodiment shown pressurized air is provided from any pressurized air source through tube 21 and inlet 17 to the inner container to force foamable liquid through delivery tube 12 to the foam producing means whence it passes through the small annular orifice 9 over the porous portion of element 7.

If foam is the desired product valve 20*a* is opened thereby allowing air to also enter the porous element through branch 22*b* of the gas delivery tube 21 and inlet 19 and pass through the porous portion of the wall thereof to mix with the foamable liquid passing through orifice 9 and over the outer surface of the porous portion 5 of the porous element 7 thereby producing foam for discharge through port 8.

However, in the event only dispensing of liquid is desired valve 20*a* is closed. Then pressurized air is applied only to the foamable liquid in container 11 through branch 22*a* of delivery tube 21 whereby said liquid is transferred to the foam producing means through conduit 12 and liquid inlet 6 and is discharged therefrom through discharge port 8 as a liquid.

Upon release of pressure within the foam dispensing device, i.e., upon cessation of dispensing of either foam or liquid, air is returned to the pressurized air source through valve 30 and the pressure in the foam dispensing device having been decreased valve 14 opens permitting liquid to enter the inner container 11 from the outer container 10 through port 15 until the liquid levels within said containers 10 and 11 and conduit 12 are equalized. Of course, other means, known to the art, may be used to return air to the pressurized air source and equalize the pressure within the system.

In the embodiment shown foamable liquid is initially present in containers 10 and 11 and tube 12 to the same height. When it is desired to dispense foam or liquid pressurized air, from a pressurized air source (not shown) enters outer container 11 through tube 21, branch 22*a* and gas inlet 17. The pressurized air causes the valve 14 to close thereby preventing any backflow from the inner container 11 to the outer container 10 through port 15. The pressurized air causes foamable liquid to rise through tube 12 and be delivered to the foam producing means 2 through inlet tube 6. The liquid then passes over the porous element 7, through orifice 9, and mixes with air passing through the pores thereof to form foam said foam then being discharged through exit port 8.

The pressurized air required for foam production is delivered into the porous element 7, through the pores of which it passes to mix with the foamable liquid to form the foam, through branch 22*b* of delivery tube 21 and inlet tube 19 which are brought into fluid connection through valve 2*a* which is open.

During delivery of pressurized air to the foam dispensing device one-way valve 30 is closed due to the pressurized air forcing ball 25 against seat 24. After dispensing of the foam, the pressurized air delivery is terminated whence the pressure in the system drops. Valves 30 opens to allow atmospheric air to enter the system and valve 14 opens to allow foamable liquid to enter container 11 and tube 12 from container 10.

When it is desired to dispense liquid the above steps and effects are repeated except that valve 20*a* is maintained in a closed condition thereby preventing entrance of air into the porous element 7 and therethrough to mix with the foamable liquid. Then, the liquid delivered to the foam producing means through inlet tube 6 passes over the porous element 7 and, lacking air to mix with to form foam, is discharged through port 8 as a liquid.

In a modification of the above embodiment of the foam dispensing device the two-way valve 20*a* for controlling gas flow to the inner container 11 and, if desired to the foam producing means is replaced by a three-way valve 20*b*, as shown in FIG. 6, situated at the branching point of tube 21 and branches 22*a* and 22*b*. In this embodiment the valve 20*b* is opened only to branch 22*a* (FIG. 6(*b*)) if dispensing of liquid is desired or to both branches 22*a* and 22*b* (as shown in FIG. 6(*a*)) if it is desired to dispense foam.

A second embodiment of this invention illustrated in FIGS. 7–13 discloses a hand held device 140 for the dispensing of foamable liquids, alternatively, as either liquids or foams said device comprising a foam producing means and a liquid reservoir to supply foamable liquid to said foam producing means.

Said foam producing means comprises a housing 170 comprising a base 177 from which a wall 171 and a ring 172 spaced inwardly from said wall rise vertically. Said base further comprises a gas transmission port 174, spaced inwardly from said ring 172 and off center, and at least one liquid transmission port 175 between said wall 171 and said ring 172. Said base further comprises a partial horizontal ring 173 extending outward therefrom.

The foam producing means further comprises a porous element 160, encompassed by and spaced from said wall 171, through which foam generating gases may difuse, if production of foam is desired, to mix with foamable liquid passing over the outside of the porous element.

The porous element comprises a wall comprising a non-porous tip 162 and an opening 166 for entry of foam producing gas therethrough into the porous element. The wall of the porous element flares outwardly from said base and said tip toward the wall 171 of the housing therebetween to form a small orifice 165 for passage of foamable liquid therethrough and an annular horizontal indentation 164 to seat upon the inner ring 172 of the housing.

Figure 8:
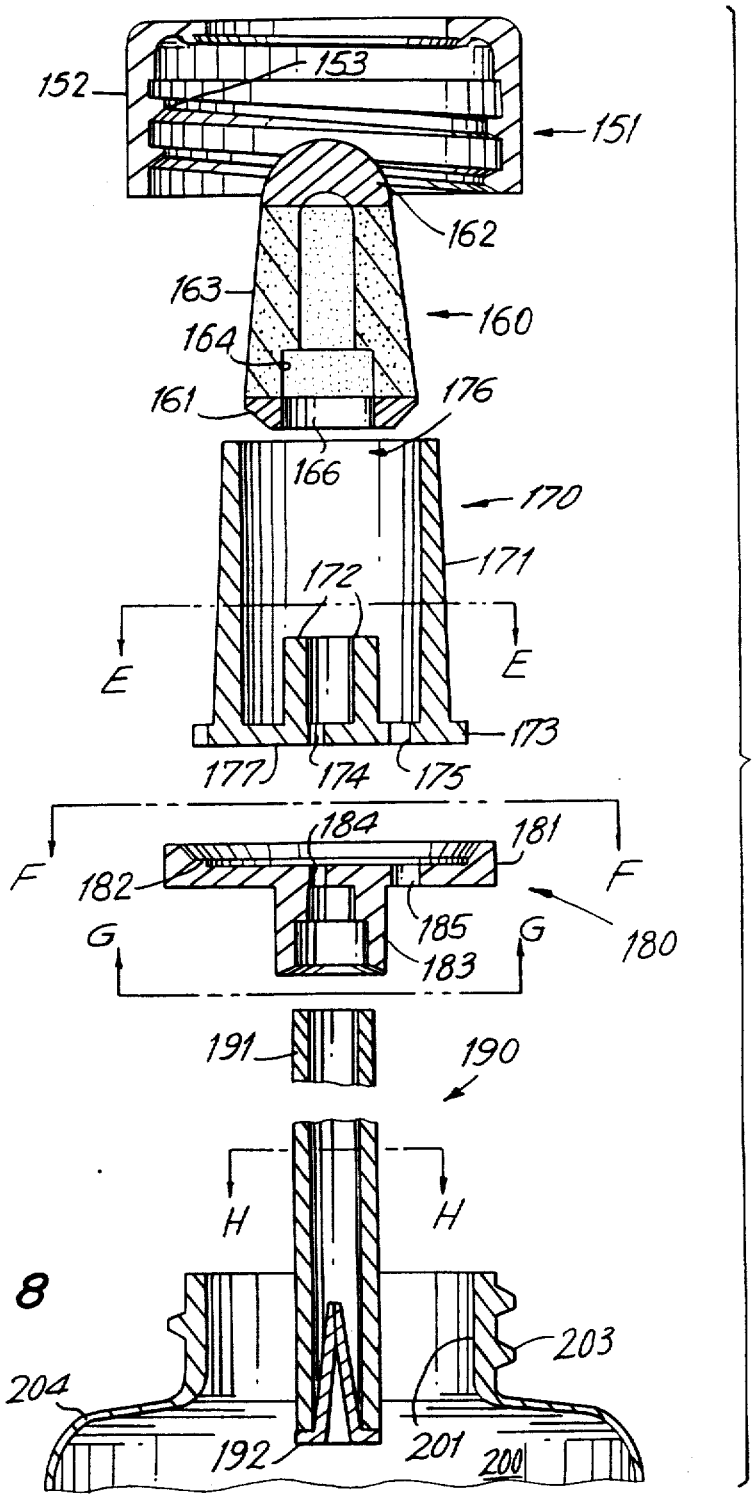
FIG. 8 is an exploded elevational view of the invention of FIG. 7.
Figure 9:
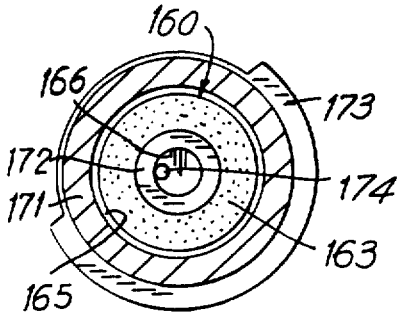
FIG. 9 is a cross-sectional view taken along line D—D of FIG. 7.
Figure 10:
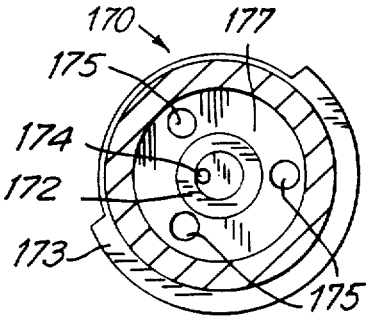
FIG. 10 is a cross-sectional view taken along line E—E of FIG. 8.
Figure 11:
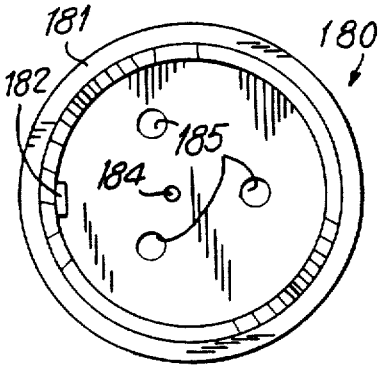
FIG. 11 is a cross-sectional view taken along line F—F of FIG. 8.
Figure 12:
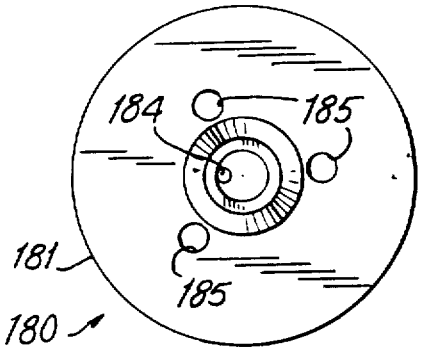
FIG. 12 is a cross-sectional view taken along line G—G of FIG. 8.
Figure 13:
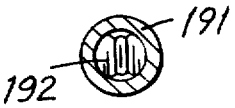
FIG. 13 is a cross-sectional view taken along line H—H of FIG. 8.
Figure 18:
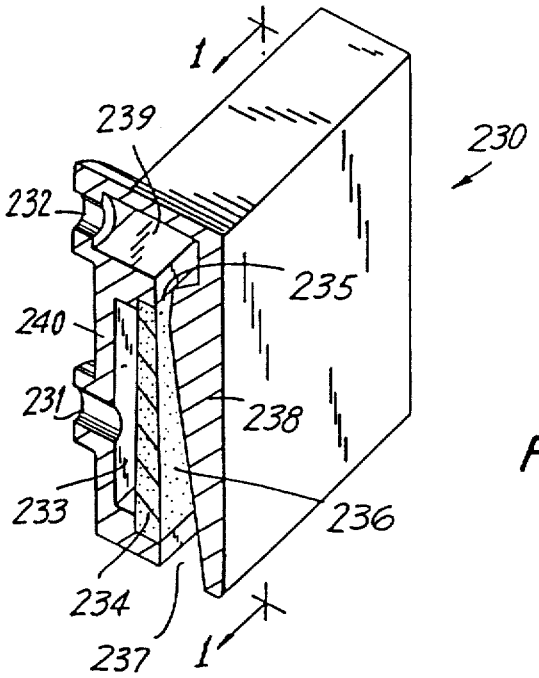
FIG. 18 is an elevational perspective view of a fourth embodiment of the invention cut away to show details.
Figure 19:
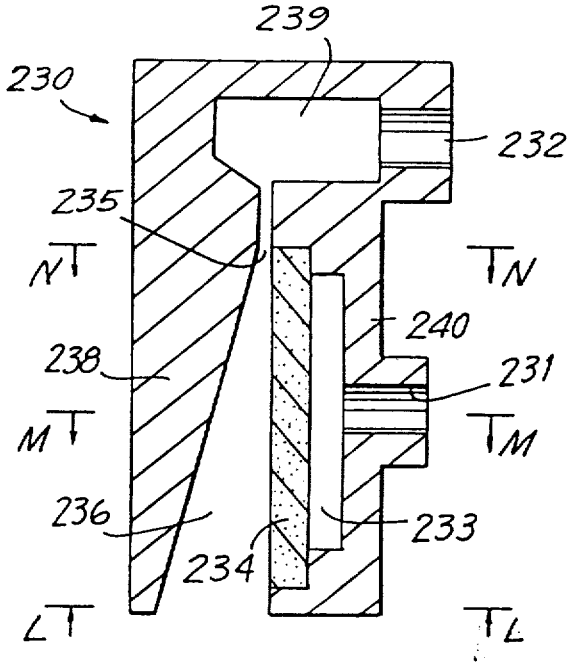
FIG. 19 is a side elevational cross-sectional view taken along line 1—1 of FIG. 18 in the direction indicated.
Figure 20:
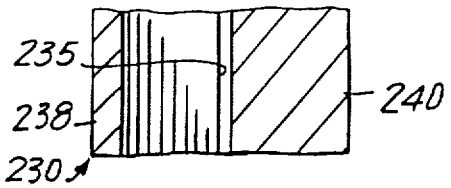
FIG. 20 is a sectional view taken along L—L of FIG. 19 in the direction indicated.
Figure 21:
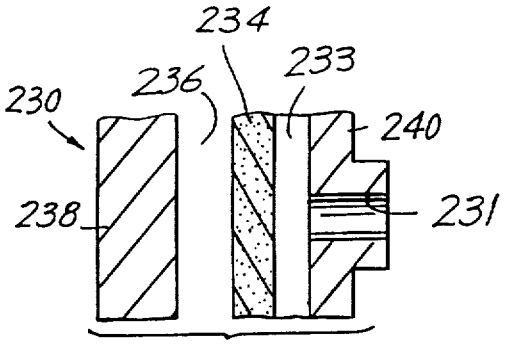
FIG. 21 is a sectional view taken along line M—M of FIG. 19 in the direction indicated.
Figure 22:
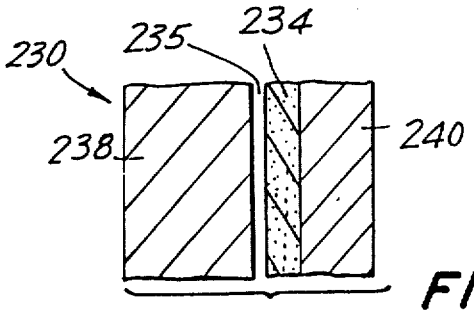
FIG. 22 is a sectional view taken along line N—N of FIG. 19 in the direction indicated.

As shown in FIG. 8 the foam producing means further comprises a fluid control base 180 comprising an outer wall 181 rising vertically therefrom, a vertical wall 183 descending vertically therefrom, at least one liquid transmission port 185 situated between wall 181 and 183, a gas transmission port 184 spaced inwardly from said ring 183 as well as a tab 182 protruding horizontally outward from said wall 181 to engage, as desired, one or another of the ends of ring 173 of the base 177.

The housing 170 may be rotated within the base 177 whereby the tab 182 may engage one or another end of ring 173 to alloy alignment of the liquid transmission ports 175 and 185 and, if desired, gas transmission ports 174 and 184.

The control base 180 also comprises a gas transmission conduit 190 comprising a hollow tube 191, inserted in and descending from ring 183, in fluid connection with the gas transmission port 184 said tube being closed at its other end by a one-way valve 192.

The foam producing means also comprises a non-rigid container 200 for supplying liquid and, if desired, air to the foam producing means. The container 200 comprises a discharge port 202, at its upper end which comprises a wall 201 comprising at its upper end a neck the vertical wall of which comprises on its outside threads 203 to engage the threads 153 of the cap 151.

In the practice of foam or liquid dispensing using this embodiment of the invention the container is partially filled with foamable liquid. The container is then inverted whereby the end of the gas delivery conduit 190 is situated above the level of said liquid. The wall 204 of the container is squeezed thereby applying pressure to the liquid and the one-way valve 192 which opens to allow entry of gas therein.

If the dispensing of liquid is desired the housing 170 is rotated, within the base 180, to engage one end of ring 173 and tab 182 whereby the liquid transmission ports 175 and 185 of the housing 170 and base 180, respectively, are aligned. Then upon squeezing the container foamable liquid is forced therefrom through the liquid transmission ports 185 and 175 and through orifice 165 to exit through port 176. In this position the gas transmission ports 174 and 184 are not aligned and no gas can pass through the porous element to mix with the foamable liquid streaming over the outer wall of the porous element to generate foam.

However, if foam production is desired the housing 170 is rotated, within base 180 to cause the other end of ring 173 and tab 182 to engage whereby all of the gas transmission ports and liquid transmission ports are aligned. Then liquid passes through the liquid transmission ports to pass over the outer wall of the porous element and air passes through the wall of said porous element to mix therewith and form foam which is dispensed through port 176.

The air is supplied to gas transmission port 184 through conduit 190 when valve 192 opens upon increasing the pressure within the container by squeezing it. Upon release of pressure on the container valve 192 closes so that no liquid may enter tube 191 when the container is upright. Then air is permitted to reenter the container thus equalizing the pressure therein and providing for a new supply of air when next dispensing of liquid or foam is desired.

Yet a third embodiment of the foam producing means of the invention, designated by the numeral 210 and illustrated in FIGS. 14–17, comprises a housing 220, the upper wall comprises a liquid entry port 212 and the lower wall a foam or liquid exit port 217 and the side wall at least one gas entry port 211. A portion of the inner side of said side wall further comprises a porous element comprising a gas permeable wall and a gas distribution plenum 213 said gas distribution plenum being in fluid connection with pressurized gas supply means such as are described with respect to the first embodiment, through the gas entry port 211. The housing encompasses a wall 218 opposite said gas permeable wall and spaced therefrom by a mixing chamber 216. At the smallest distance between said gas permeable wall 214 and said opposite wall 218 there is formed an annular orifice 215 for passage of foamable liquid from a liquid distribution plenum 219 therethrough and into mixing chamber 216.

Said liquid distribution plenum 219 is in fluid connection with a foamable liquid source, such as is described above with respect to the first embodiment, through the liquid entry port 212.

In the use of this embodiment of the invention foamable liquid is caused to enter the the foam producing device 210 through the liquid entry port 212, as described above, and passes through said liquid distribution plenum 219 and orifice 215 into the mixing chamber 216. If dispensing of foam is desired gas is permitted, as described above with respect to the first embodiment, to enter the gas distribution plenum 213, through gas entry port 211, and therefrom into said gas permeable wall 214 from which it permeates to mix with said foamable liquid to form the foam which is discharged through foam or liquid exit port 217.

In the event that only the discharge of liquid is desired the above steps are effected except that the entrance of the gas into the porous element is prevented by closure of the valve between the gas supply means and the gas entry port 211.

Yet a fourth embodiment of the invention, generally designated by numeral 230, is illustrated in FIGS. 18–22 wherein the foam producing device comprises a planar housing 230 comprising a porous element comprising a gas permeable wall 234, a gas distribution plenum 233 in fluid connection therewith a gas entry port 231 between, and in fluid connection with, said gas distribution plenum 233 and a pressurized gas source. Said housing further comprises in a portion of its inner wall a wall 238 opposite to said gas permeable wall 234 the space therebetween forming a mixing chamber 236. If desired, said opposite wall 238 may be tapered.

Said housing further comprises a liquid distribution plenum 239 in fluid connection with said mixing chamber 236 and a foamable liquid supply source through liquid entry port 232. The liquid distribution plenum 239 is in fluid connection with said mixing chamber 236 through a lengthwise orifice 235 at the smallest distance between said opposite wall 238 and the gas permeable wall 234.

The use of this embodiment of the invention is essentially as described above. Foamable liquid is caused to enter the mixing chamber 236 of the device through liquid entry port 232, liquid distribution plenum 239 and orifice 235 whence it passes over opposite wall 238 and/or gas permeable wall 234.

If dispensing of foam is desired pressurized gas enters the mixing chamber 236 through gas entry port 231, gas distribution plenum 233 and the gas permeable wall 234 where it mixes with said foamable liquid to form foam which is discharged through discharge port 237.

In the event only dispensing of liquid is desired the above steps are effected except for the steps transmitting gas to the mixing chamber 236.

It is to be understood that all opposite or porous walls may be tapered or not in accordance with the user's requirements.

Furthermore, the orifice sizes and choices of permeable as well as other materials of construction will also be depend upon the operator's needs as well as compatability considerations.

The invention having been described with reference to specific embodiments thereof it is to be understood that variations and modifications may be made therein without departing from the scope of the invention.

I claim:

1. A foam producing device for the alternative dispensing of foams or liquids comprising:

(a) a porous element comprising:
  (1) a hollow partially gas permeable wall;
  (2) a gas distributing plenum; and
  (3) a gas entry port in fluid connection with said plenum;

(b) a second wall opposite an inner radial surface of said gas permeable wall;

(c) a mixing chamber comprising:
  (1) at one end, the proximal end, a small annular opening between said gas permeable and second wall, comprising an orifice for the uniform distribution of foamable liquids therethrough and into said chamber; and
  (2) at the opposite, distal end an exit port for the discharge of foams or liquids from said chamber;

(d) a liquid supply element comprising:
  (1) a liquid distribution plenum for the uniform distribution of said foamable liquids to said orifice; and
  (2) a liquid entry port in fluid connection with said plenum and a pressurized foamable liquids supply;

(e) pressurized gas supply means comprising:
  (1) a reservoir for said gas, and
  (2) conduit means between, and in fluid connection with, said reservoir and said gas entry port; and (f) foamable liquid supply means comprising
  (1) a reservoir for said foamable liquid; and
  (2) conduit means between, and in fluid connection with, said liquid entry port;

with the proviso that only the portion of said gas permeable wall between said orifice and said exit port is gas permeable.

2. The device of claim 1 wherein said chamber is tapered the distance between said gas permeable wall and said second wall increasing with increasing distance from said orifice towards said discharge port.

3. The device of claim 2 wherein the second wall is tapered.

4. The device of claim 1 further comprising valve means to control the entrance of said pressurized gas to said gas distribution plenum said valve means being closed when only dispensing of liquid is desired.

5. The foam producing device according to claim 1 wherein said foamable liquid supply means comprises a large first container comprising a discharge port closed by a cap comprising:

(a) a gas inlet port therethrough from which vertically rises a gas inlet tube in fluid connection with a pressurized gas source;

(b) a liquid outlet port therethrough from which vertically rises a liquid outlet tube in liquid connection with the foam producing device and the inner container;

(c) a tubular element inwardly spaced from the wall of said large first container and descending vertically from the bottom wall of said cap said tube defining an inner second container within said first container said tube comprising at its lower end a port for liquid connection with said first container and a one-way valve for closing of said port when the pressure within said second container is greater than within the first container; and (d) a small third tube, within said second container, descending vertically from the bottom of and said cap spaced inwardly from the wall of said inner container and outwardly from the liquid outlet port and defining a liquid conduit in liquid connection at its upper end with the liquid outlet means and having an opening in its lower end for liquid connection with said second container.

6. The foam producing device according to claim 1 wherein said pressurized gas supply and delivery means comprises:

(a) a pressurized gas source;

(b) a tube in fluid connection with said source comprising at least two branches wherein
  (1) a first branch is in fluid connection with the gas inlet tube of the liquid delivery means; and
  (2) a second branch is in fluid connection with the gas inlet tube of the foam producing device said second branch comprising valve means to prevent delivery of gas to said foam producing device when only dispensing of liquid is desired.

7. The foam producing device according to claim 6 wherein said valve is selected from the group comprising two-and three-way valves.

8. The foam producing device according to claim 7 wherein said valve is a two-way valve placed in the branch in fluid connection with the porous element downstream of the branching point.

9. The foam producing device according to claim 7 wherein said branching point comprises a three-way valve.

* * * * *

UNITED STATES PATENT AND TRADEMARK OFFICE

CERTIFICATE OF CORRECTION

PATENT NO. : 4,991,779

DATED : February 12, 1991

INVENTOR(S) : Joseph W. Blake, III

It is certified that error appears in the above-identified patent and that said Letters Patent is hereby corrected as shown below:

The title page should be deleted to appear as per attached title page.

Drawings sheets 2 should be deleted to be replaced with drawing sheets 1-10 consisting of Figs. 1-22 as shown on the attached pages.

Signed and Sealed this

Tenth Day of November, 1992

*Attest:*

DOUGLAS B. COMER

*Attesting Officer*

*Acting Commissioner of Patents and Trademarks*

United States Patent [19]
Blake, III

[11] Patent Number: 4,991,779
[45] Date of Patent: Feb. 12, 1991

[54] FOAM GENERATING DEVICE

[76] Inventor: Joseph W. Blake, III, 88 Main St., New Canaan, Conn. 06840

[21] Appl. No.: 481,435

[22] Filed: Feb. 16, 1990

Related U.S. Application Data

[62] Division of Ser. No. 57,037, Jun. 2, 1987, Pat. No. 4,901,925.

[51] Int. Cl.[5] ..... B05B 7/32
[52] U.S. Cl. ..... 239/343; 222/189; 222/190; 239/346; 239/366; 239/370; 239/371; 239/417.3; 239/432
[58] Field of Search ..... 239/343, 346, 350, 366, 239/416.5, 417.3, 417.5, 432; 222/189, 190

[56] References Cited

U.S. PATENT DOCUMENTS

| | | | |
|---|---|---|---|
| 3,937,364 | 2/1976 | Wright | 239/343 |
| 4,022,351 | 5/1977 | Wright | 222/190 |
| 4,044,923 | 8/1977 | Gardner | 239/343 |
| 4,531,659 | 7/1985 | Wright | 222/190 |
| 4,531,660 | 7/1985 | Ford, Jr. | 222/209 |

*Primary Examiner*—Andres Kashnikow
*Assistant Examiner*—Michael J. Forman
*Attorney, Agent, or Firm*—Seymour G. Bekelnitzky

[57] ABSTRACT

A foam producing device for the alternative dispensing of foams or liquids comprising a porous element a partially gas permeable wall, a gas distributing plenum a gas entry port in fluid connection with said plenum: a second wall opposite the outer surface of said gas permeable wall; a mixing chamber comprising at one end, the proximal end, a small annular opening between said gas permeable and second wall, comprising an orifice for the uniform distribution of foamable liquids therethrough into said chamber and at the distal end an exit port for the discharge of foams or liquids from said chamber said chamber being tapered or not, as required; a liquid distribution plenum for the uniform distribution of said foamable liquids to said orifice and a liquid entry port in fluid connection, through a conduit with said plenum wherein said plenum and a source of foamable liquid are in fluid connection through a conduit therebetween; with the proviso that only the portion of said gas permeable wall between said orifice and said exit port is gas permeable said device further comprising, in the conduit between said pressurized gas source and said gas distributing plenum valve means to prevent entrance of said gas to said device when only the dispensing of liquid is desired.

9 Claims, 10 Drawing Sheet

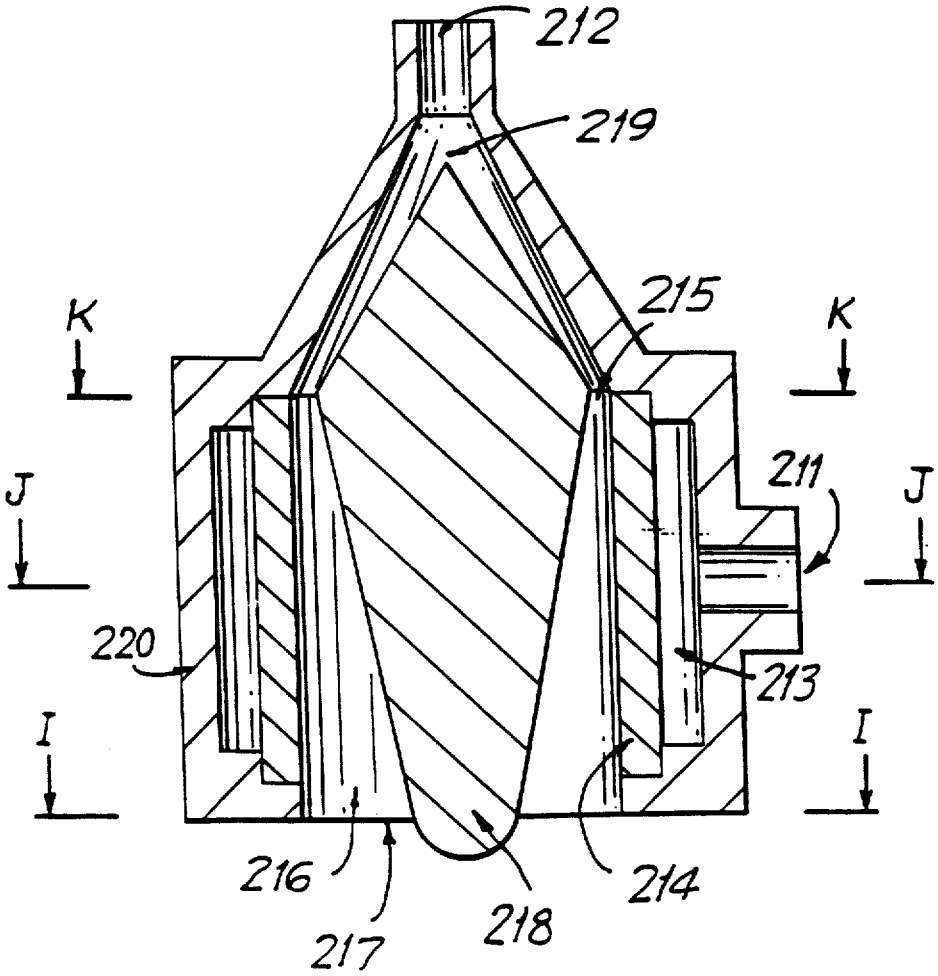

FIG. 6a
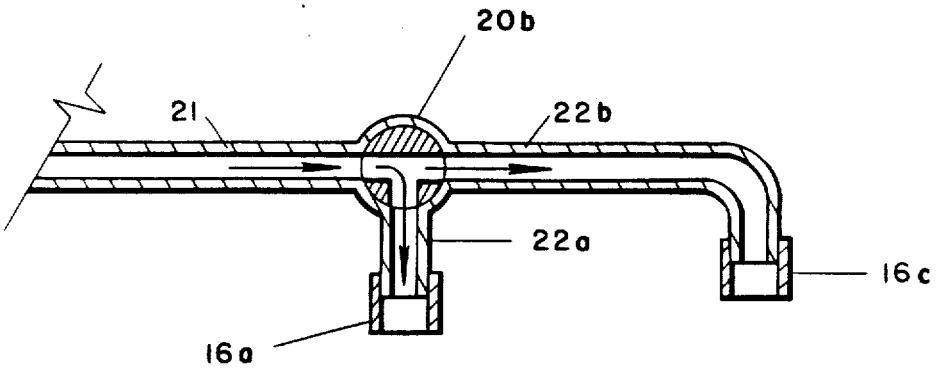
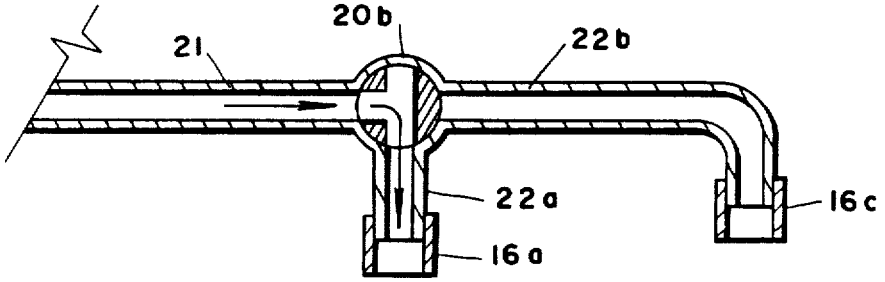
FIG. 6b

FIG. 14
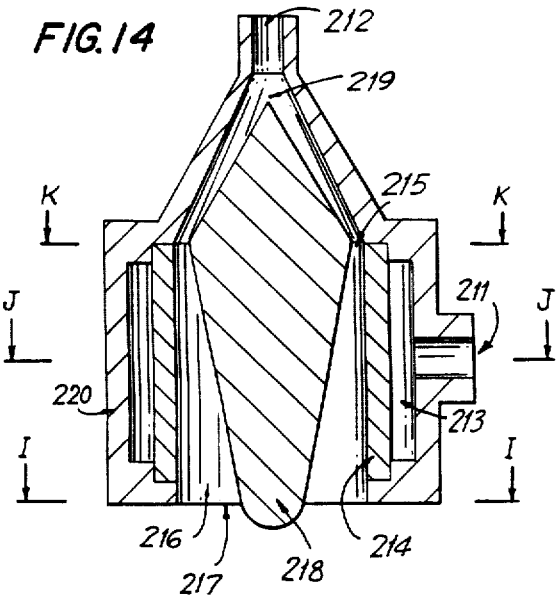
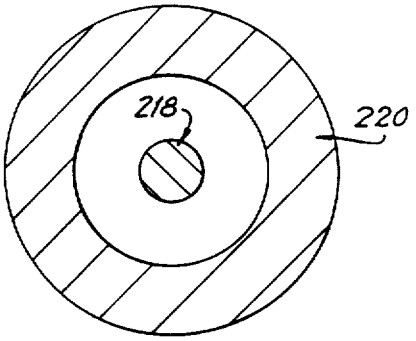
FIG. 15

FIG. 16
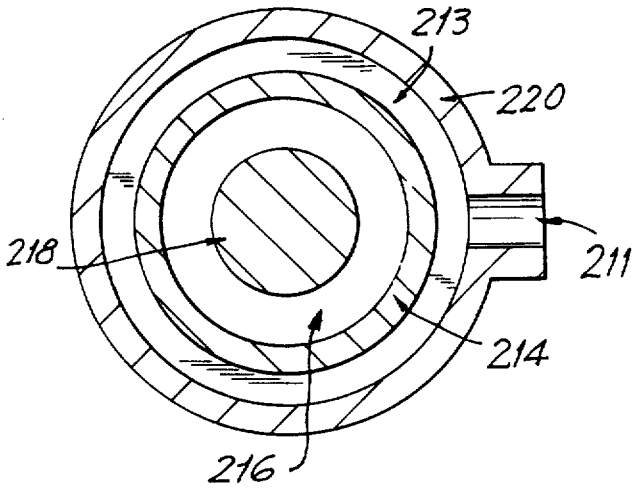
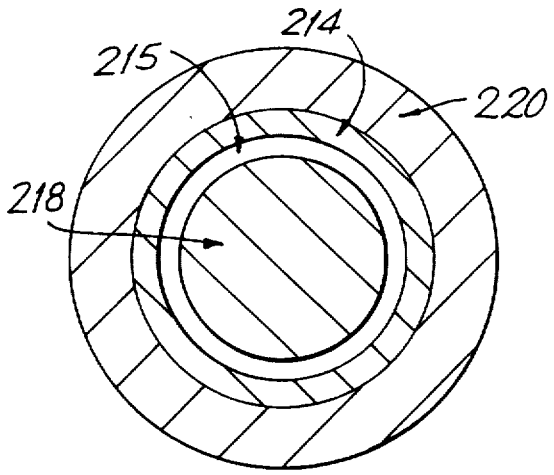
FIG. 17